US010132052B2

(12) United States Patent
Dang et al.

(10) Patent No.: US 10,132,052 B2
(45) Date of Patent: Nov. 20, 2018

(54) UTILITY VAULT SUPPORT BAR SNAP FEATURE

(71) Applicant: Oldcastle Precast, Inc., Auburn, WA (US)

(72) Inventors: Nguyen Thai Dang, Pomona, CA (US); Eric Long, Weston, OH (US)

(73) Assignee: OLDCASTLE PRECAST, INC., Auburn, WA (US)

( * ) Notice: Subject to any disclaimer, the term of this patent is extended or adjusted under 35 U.S.C. 154(b) by 8 days.

(21) Appl. No.: 15/456,753

(22) Filed: Mar. 13, 2017

(65) Prior Publication Data

US 2017/0260712 A1 Sep. 14, 2017

Related U.S. Application Data

(60) Provisional application No. 62/307,289, filed on Mar. 11, 2016.

(51) Int. Cl.

| | |
|---|---|
| ***E02D 29/14*** | (2006.01) |
| ***E02D 29/12*** | (2006.01) |
| ***E04H 9/12*** | (2006.01) |
| *B65D 41/62* | (2006.01) |
| *E02D 29/00* | (2006.01) |
| *B65D 57/00* | (2006.01) |
| *B65D 37/00* | (2006.01) |
| *B65D 41/00* | (2006.01) |

(52) U.S. Cl.

CPC ..... *E02D 29/14* (2013.01); *E04H 9/12* (2013.01); *B65D 37/00* (2013.01); *B65D 41/00* (2013.01); *B65D 41/62* (2013.01); *B65D 57/00* (2013.01); *E02D 29/04* (2013.01); *E02D 29/12* (2013.01)

(58) Field of Classification Search

CPC ..... B65D 37/00; B65D 41/00; B65D 41/62; B65D 57/00; B65D 45/00; B65D 43/08; B65D 43/06; E02D 29/04; E02D 29/045; E02D 29/14; E02D 29/12; E04H 9/12

See application file for complete search history.

(56) References Cited

U.S. PATENT DOCUMENTS 3,263,853 A * 8/1966 Smith ..... E04F 19/08 174/37
3,974,599 A * 8/1976 Grosh ..... E02D 29/12 52/169.6

(Continued)

OTHER PUBLICATIONS

"Snap-Fit Joints for Plastics—A Design guide" Bayer MaterialScience LLC, Nov. 2005, 26 pages.

*Primary Examiner* — Phi D A
(74) *Attorney, Agent, or Firm* — Sheridan Ross PC

(57) ABSTRACT

A vault system is provided that secures a brace to the underside of a vault lid to improve the performance of the lid when the lid is subject to external loads. The vault has guiding features to receive a brace and place the brace in a particular position. Then, a vault lid is pressed into the vault, and tabs on the vault lid deflect into receiving portions on the ends of the brace to secure the brace to the vault lid. The resulting vault lid is reinforced with a brace. In some embodiments, the guiding feature comprises a rib in a recess in the brace, and in various embodiments, the tabs have an arm and a hook disposed on a distal end of the arm. The tab arms deflect to fit around the end of the brace, then an undercut on the hook secures the brace to the lid.

12 Claims, 9 Drawing Sheets

(56) References Cited

U.S. PATENT DOCUMENTS

| | | | | |
|---|---|---|---|---|
| 4,065,020 | A * | 12/1977 | Carson | B65D 39/08 220/293 |
| 4,163,503 | A * | 8/1979 | McKinnon | H02G 9/10 137/371 |
| 4,567,697 | A | 2/1986 | Hahne | |
| 4,861,186 | A * | 8/1989 | Ferns | E02D 29/14 404/25 |
| 6,772,566 | B1 | 8/2004 | Machledt et al. | |
| 6,899,240 | B2 | 5/2005 | Dang et al. | |
| 7,004,677 | B1 * | 2/2006 | Ericksen | A01G 25/162 137/364 |
| 7,144,189 | B1 * | 12/2006 | Bongiovanni | B65D 90/105 404/25 |
| 7,163,352 | B2 | 1/2007 | Jurich et al. | |
| 7,385,137 | B2 | 6/2008 | Burke et al. | |
| 7,467,910 | B2 | 12/2008 | Lecuyer et al. | |
| 7,748,926 | B2 | 7/2010 | Jurich et al. | |
| 8,835,757 | B2 | 9/2014 | Freeman | |
| 9,435,099 | B2 | 9/2016 | Dang | |

* cited by examiner

UTILITY VAULT SUPPORT BAR SNAP FEATURE

CROSS-REFERENCE TO RELATED APPLICATIONS

This application claims priority under 35 U.S.C. § 119(e) to U.S. Provisional Patent Application Ser. No. 62/307,289 filed Mar. 11, 2016, which is incorporated herein in its entirety by reference.

FIELD OF THE INVENTION

The present invention relates generally to vaults for providing an enclosed region beneath a ground surface for underground utilities such as electrical, communications, mechanical wiring, and water fixtures. More specifically, the present invention includes a vault lid that that is reinforced with a brace to improve the performance of the vault system when the lid and sidewalls of the utility vault are subject to external loads.

BACKGROUND OF THE INVENTION

Subgrade utility vaults are widely used to provide internal enclosed regions where utility connections can be made and housed. Classic examples of such connections are the joining of electrical cables used in street lighting, fiber optic cables in telephone and communication systems, and water valves for residential communities and golf courses. These vaults are generally placed below ground level with their upper surfaces at grade where loads from pedestrians and vehicles, as well as environmental factors such as the precipitation and animals, are anticipated. Generally the vaults will be used by municipalities, utility companies, and homeowners at locations where longevity, durability, and affordability are important criteria.

Prior art vaults typically comprise a lid to enclose a vault and protect the contents of the vault against external loads and environmental conditions. The following references relate to the field of subgrade vaults and facilities and are hereby incorporated by reference in their entireties: U.S. Pat. No. 4,567,697 to Hahne; U.S. Pat. No. 6,772,566 to Machledt et al.; U.S. Pat. No. 6,899,240 to Dang et al.; U.S. Pat. No. 7,163,352 to Jurich et al.; U.S. Pat. No. 7,385,137 to Burke et al.; U.S. Pat. No. 7,467,910 to Lecuyer et al.; and U.S. Pat. No. 7,748,926 to Jurich et al.

External loads are considered in prior art designs since, as noted above, subgrade utility vaults can experience loads from pedestrians or even vehicles traveling over the top of the subgrade utility vault and vault lid. The Society of Cable Telecommunications Engineers ("SCTE") maintains load standards for utility vaults, including ANSI/SCTE 77 2013, entitled "Specification for Underground Enclosure Integrity," which is hereby incorporated by reference in its entirety. The ANSI/SCTE 77 2013 standard outlines different load requirements for different applications of a utility vault and lid. Tier 15 and Tier 22 applications include "[d]riveway, parking lot, and off-roadway applications subject to occasional non-deliberate heavy vehicular traffic." See Table 1, pg. 9. The vertical design loads for Tier 15 and Tier 22 applications are 15,000 lbs and 22,500 lbs, respectively. These design loads are the expected loads on the utility vault with a safety factor of 1.5.

An issue with prior art vaults is that the lid is supported only by a peripheral lip around a perimeter of the lid, and the lid and/or vault may deform, distort, or break in Tier 15 or Tier 22 applications. For example, since the lid rests on a horizontal lip or seat of the vault and the relative position between the lid and the horizontal lip or seat is not fixed or maintained, the center of the lid can deflect downward when a person steps on the lid. The ability of the lid to secure to the vault can become compromised, and any sensitive equipment and expensive commodities within the vault are exposed to damage or theft. Therefore, there is a long-felt but unmet need to provide a subgrade utility vault system, and methods for creating such systems, to improve the structural integrity of the vault system.

SUMMARY OF THE INVENTION

The above needs and other needs are addressed by the various embodiments and configurations of the present invention. This invention relates to a brace that can be interconnected to a utility vault lid to reinforce the lid against substantial and routine loads, for example, Tier 15 and Tier 22 applications from the ANSI/SCTE 77 2013 standard. The brace improves the rigidity of the lid and transfers vertical loads to the vault. In addition, the invention provides a method to install the brace that foregoes the use of tools and substantial manipulation of the vault lid and/or the vault itself.

It is one aspect of embodiments of the present invention to provide an interconnection between the vault lid and the brace. The vault lid may comprise two deflectable tabs that extend downward from sides of the vault lid. The brace may comprise receiving portions on either end of the brace, and in some embodiments, the receiving portions are the ends of an aperture that passes through a longitudinal length of the brace. In other embodiments, the receiving portions can be depressions or recesses. The brace and vault lid are aligned and pressed together such that the tabs on the lid deflect outward and around the ends of the brace. Then, when the ends of the tabs are positioned in the center of the receiving portions, the tabs deflect inwards and undercuts on the tabs preserve the interconnection between the vault lid and the brace.

It is another aspect of embodiments of the present invention to provide a method for installing a brace on a utility vault lid that uses no tools and requires no substantial manipulation of the subgrade utility vault or the lid. First, the brace is positioned within the subgrade utility vault. Guide features in the vault align and channel the brace into a particular position and orientation. Then, the lid is positioned on the subgrade utility vault as done during normal operation of the subgrade vault. However, with the present invention, tabs on the lid deflect and then interconnect to the ends of the brace positioned in the subgrade utility vault. Thus, no separate tools are used to reinforce the lid with a brace. Instead, the brace is simply positioned in the subgrade utility vault before placing the lid on the vault.

It is yet another aspect of embodiments of the present invention to provide guide features for aligning a brace in a subgrade utility vault. The guide features may be positioned on opposing walls in the subgrade utility vault to receive each end of a substantially linear shaped brace. The guide features may have a recess in the walls to receive an end of the brace, as well as a shoulder to support the brace and inherent load. This recess aligns the brace in a lateral direction, meaning the side-to-side movement of the brace is restricted when each end of the brace is resting in the recesses of the guide features. Next, the guide features may each comprise one or more ribs positioned in the recess. In various embodiments, these ribs slope toward the center of the subgrade utility vault. Thus, if the brace is too close to one wall when being placed in the subgrade utility vault, then the rib on that wall directs the brace to a centered positioned due to the slope of the rib. Therefore, the various components of the guide features align and channel the brace to a specific position and orientation to ensure a complete interconnection with the lid when the lid is placed on the vault.

It will be appreciated that embodiments of the present invention include brace configurations beyond a substantially linear shaped bar with two opposing ends. In some embodiments, the brace may be a substantially rectangular shape with a square cross section and guide features on four walls position the cross-shaped brace. Further still, the brace may comprise other geometric shapes and combined geometric shapes. For example, the brace may comprise a ring centered on the vault lid, and then the brace comprises arms that extend from the ring and rest in guide features.

The components of the present invention may be made from a variety of materials and/or combinations of materials. The brace in some embodiments may be made from tubular steel, fiberglass, rigid plastic, or other components and the vault and lid may be made from injection molded plastic. However, it will be appreciated that these components, and others described herein, may be made from other materials. For example, the vault or lid may be made from steel, fiberglass, or concrete. In addition, it may be desirable to retrofit existing vaults and lids with embodiments of the present invention. Existing vaults may have guide features cut out or affixed to the vault, and the brace and lid may be interconnected to each other by, for example, screws or bolts.

One particular embodiment of the present invention is a subgrade structure for providing an enclosure for storing utilities, comprising a vault having at least a first wall and an opposing second wall that at least partially define an enclosure, the vault having a first guide feature positioned on the first wall and a second guide feature positioned on the second wall; a brace with a first end having a first receiving portion and a second end having a second receiving portion, the first and second guide features configured to align the first and second ends of the brace between the first wall and the second wall; and a lid having a first tab and a second tab, the first tab operable for interconnection to the first receiving portion of the brace, and the second tab operable for interconnection to the second receiving portion of the brace, wherein the lid is configured to cover an opening of the vault to form the enclosure.

In some embodiments, the first tab of the lid comprises a hook disposed on a distal end of an arm. In various embodiments, an aperture extends from the first end to the second end of the brace to define the first receiving portion and the second receiving portion of the brace. In some embodiments, the first and second receiving portions are depressions in the brace.

In various embodiments, the subgrade structure further comprises a first rib on the first guide feature; and a second rib on the second guide feature, wherein the first and second ribs are configured to align the brace relative to the first and second walls in a longitudinal direction of the brace. In some embodiments, the first rib has a downward slope toward a center of the vault, and the second rib has a downward slope toward the center of the vault. In various embodiments, the subgrade structure further comprises a first recess on the first guide feature, the first recess having a geometric profile adapted to receive an outer cross section of the brace; and a second recess on the second guide feature, the second recess having a geometric profile adapted to receive the outer cross section of the brace, wherein the first and second recesses are configured to align the brace relative to the first and second walls in a lateral direction of the brace.

In some embodiments, the subgrade structure further comprises a first side tab and a second side tab on the lid, wherein the first side tab and the second side tab are positioned on either side of the first tab, wherein the side tabs are configured to align the lid relative to the brace in a lateral direction of the brace. In various embodiments, the first rib and the second rib each have an upper surface configured to engage the brace, wherein the upper surfaces are substantially linear. In some embodiments, the subgrade structure further comprises a first space between a first end of the brace and the first wall, wherein the first tab deflects beyond the first end of the first brace by a predetermined distance, and the first space is larger than the predetermined distance.

Another particular embodiment of the present invention is a method for installing a brace on a utility vault lid, comprising (i) providing a vault with a first wall and an opposing second wall, the vault having a first guide feature positioned on the first wall and a second guide feature positioned on the second wall; (ii) positioning a brace within the first and second guide features of the vault, wherein a first end of the brace has a first guide feature, and a second end of the brace has a second guide feature; and (iii) inserting a utility vault lid within the vault and onto the brace, the utility vault lid having a first tab and a second tab, wherein the first tab interconnects to the first guide feature of the first end of the brace and the second tab interconnects to the second guide feature of the second end of the brace to secure the brace to the utility vault lid.

In some embodiments, the first tab of the utility vault lid comprises a hook disposed on a distal end of an arm. In various embodiments, an aperture extends from the first end to the second end of the brace to define the first guide feature and the second guide feature. In some embodiments, the first tab of the utility vault lid comprises at least one of a hook, a stud, and a bead.

In various embodiments, the method further comprises (iv) providing a first rib on the first guide feature, the first rib having a downward slope toward a center of the utility vault; (v) providing a second rib on the second guide feature, the second rib having a downward slope toward the center of the utility vault; and (vi) aligning, by the first and second ribs, the brace relative to the first and second walls in a longitudinal direction of the brace. In some embodiments, the method further comprises (vii) providing a first recess on the first guide feature, the first recess having an internal cross section substantially similar to an outer cross section of the brace; (viii) providing a second recess on the second guide feature, the second recess having an internal cross section substantially similar to the outer cross section of the brace; and (ix) aligning, by the first and second recesses, the brace relative to the first and second walls in a lateral direction of the brace. In various embodiments, the method further comprises (x) providing a first side tab and a second side tab on the lid, wherein the side tabs are positioned on either side of the first tab; and (xi) aligning, by the side tabs, the lid relative to the brace in a lateral direction of the brace. In some embodiments, the slope of the first rib is linear, and the slope of the second rib is linear.

Yet another particular embodiment of the present invention is a utility vault defining an enclosed volume, comprising at least one sidewall having a first guide feature and a second guide feature, wherein the guide features each comprise a recessed area having a rib; a brace having a first end and a second end with an aperture extending through the brace between the first end and the second end, wherein the ribs of the first and second guide features are configured to orient the brace into a predetermined position in a longitudinal direction of the brace, and the recessed areas of the first and second guide features are configured to orient the brace into a predetermined position in a lateral direction of the brace; and a lid having a first tab and a second tab, each tab having an arm and a hook, wherein the hook of the first tab is configured to deflect into the aperture of the brace, and the hook of the second tab is configured to deflect into the aperture of the brace to secure the brace to the lid.

In some embodiments of the invention, the first and second ends of the brace are mitered at a non-perpendicular angle relative to the longitudinal direction of the brace. This brace is oriented in the utility vault so that the shorter side of the brace faces the lid. Therefore, a space is created between the ends of the shorter side of the brace and the sidewalls of the utility vault. The tabs of the lid deflect outward into this space before interconnecting to the brace. Thus, the mitered ends of the brace provide space for the tabs to deflect outwards.

The Summary of the Invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements or components. Additional aspects of the present invention will become more readily apparent from the Detailed Description, particularly when taken together with the drawings.

The above-described embodiments, objectives, and configurations are neither complete nor exhaustive. As will be appreciated, other embodiments of the invention are possible using, alone or in combination, one or more of the features set forth above or described in detail below.

The phrases "at least one," "one or more," and "and/or," as used herein, are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

BRIEF DESCRIPTION OF THE DRAWINGS

The accompanying drawings, which are incorporated in and constitute a part of the specification, illustrate embodiments of the invention and together with the Summary of the Invention given above and the Detailed Description of the drawings given below, serve to explain the principles of these embodiments. In certain instances, details that are not necessary for an understanding of the invention or that render other details difficult to perceive may have been omitted. It should be understood, of course, that the invention is not necessarily limited to the particular embodiments illustrated herein. Additionally, it should be understood that the drawings are not necessarily to scale.

Figure 1:
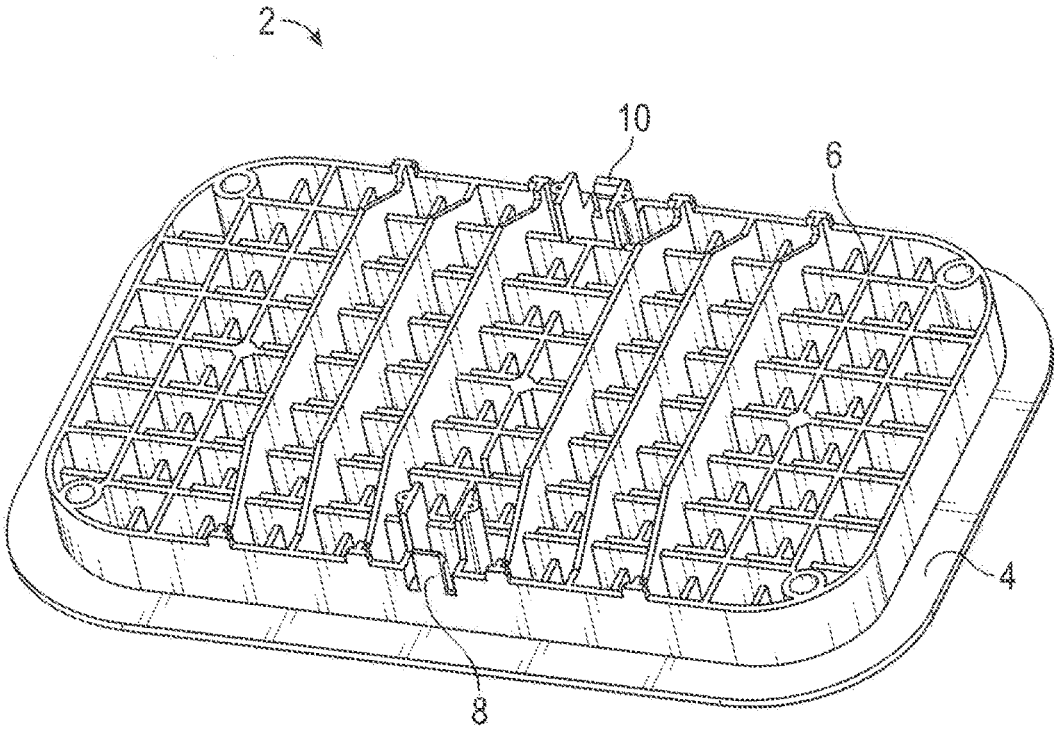
FIG. 1 is a perspective view of a utility vault lid with first and second tabs in accordance with various embodiments of the invention.

Similar components and/or features may have the same reference label. Further, various components of the same type may be distinguished by following the reference label by a letter that distinguishes among the similar components. If only the first reference label is used, the description is applicable to any one of the similar components having the same first reference label irrespective of the second reference label.

A list of the various components shown in the drawings and associated numbering is provided herein:

| Number | Component |
|---|---|
| 2 | Lid |
| 4 | Lip |
| 6 | Lattice |
| 8 | First Tab |
| 10 | Second Tab |
| 12 | Brace |
| 14 | Side Tab |
| 16 | Vault |
| 18 | First Wall |
| 20 | Second Wall |
| 22 | Shoulder |
| 24 | Guide Feature |
| 26 | Recess |
| 28 | Rib |
| 30 | Receiving Portion |
| 32 | Arm |
| 34 | Hook |
| 36 | Undercut |
| 38 | Gap |

DETAILED DESCRIPTION

The present invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, may be modified in numerous ways within the scope and spirit of the invention.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Various embodiments of the present invention are described herein and as depicted in the drawings. It is expressly understood that although the figures depict vaults, lids, and braces, and methods and systems for using the same, the present invention is not limited to these embodiments. Further, some terms may be used interchangeably, for example, "subgrade utility vault," "utility vault," and "vault" may be used interchangeably.

Referring to FIG. 1, a perspective view of the underside of a utility vault lid 2 is provided. The lid 2 encloses a subgrade utility vault and protects the contents of the vault such as electrical and fiber optic cables. A lip 4 extends around a perimeter of the lid 2, and the lip 4 rests on a top surface of the vault. A lattice structure 6 extends from the lip 4 of the vault lid 2 and provides rigidity to the lid 2. First and second tabs 8, 10 are positioned on either side of the lattice structure 6. These tabs 8, 10 are the locations where a brace interconnects to the lid 2 to reinforce the lid 2.

In an alternative embodiment, the brace can be a permanent part of the lid structure, i.e., it does not need to be snapped into place within the lid. It will be appreciated that the brace can be formed along with the lid, and thus, for example, both the lid and the brace may be plastic or any other material. Further, the lid and the brace are permanently joined with an adhesive or welding.

Figure 2A:
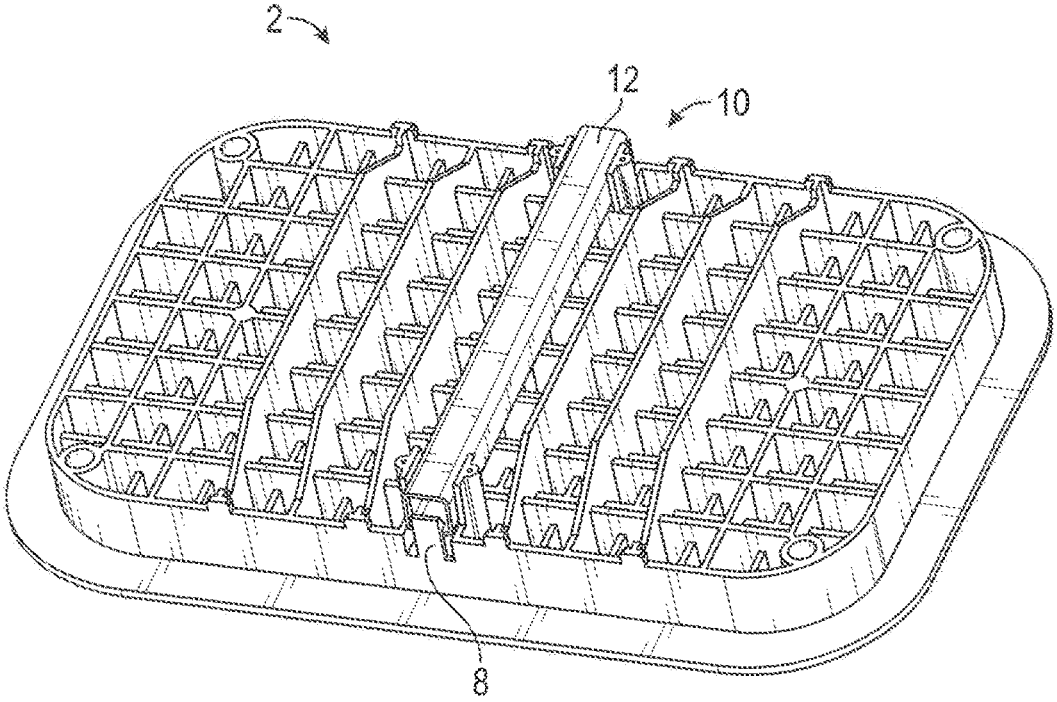
FIG. 2A is a perspective view of a utility vault lid with a brace interconnected to both of the first and second tabs of the lid in accordance with various embodiments of the invention.

Now referring to FIG. 2A, a perspective view of a utility vault lid 2 is provided where the lid 2 has a brace 12 that allows the lid 2 to handle, for example, Tier 15 and Tier 22 applications as specified in the ANSI/SCTE 77 2013 standard. The ends of the brace 12 are positioned in the tabs 8, 10 so that the brace 12 is interconnected, selectively or permanently, to the lid 2. When the lid 2 covers the subgrade utility vault, the lid 2 is subject to external loads, which can be large. For example, pedestrians may walk on the lid 2 when the lid 2 is on a sidewalk, or the vault and lid 2 may be in a street and routine vehicular traffic is expected to travel over the lid 2. Added reinforcement from the brace 12 improves the load capacity of the utility vault and lid 2.

Figure 2B:
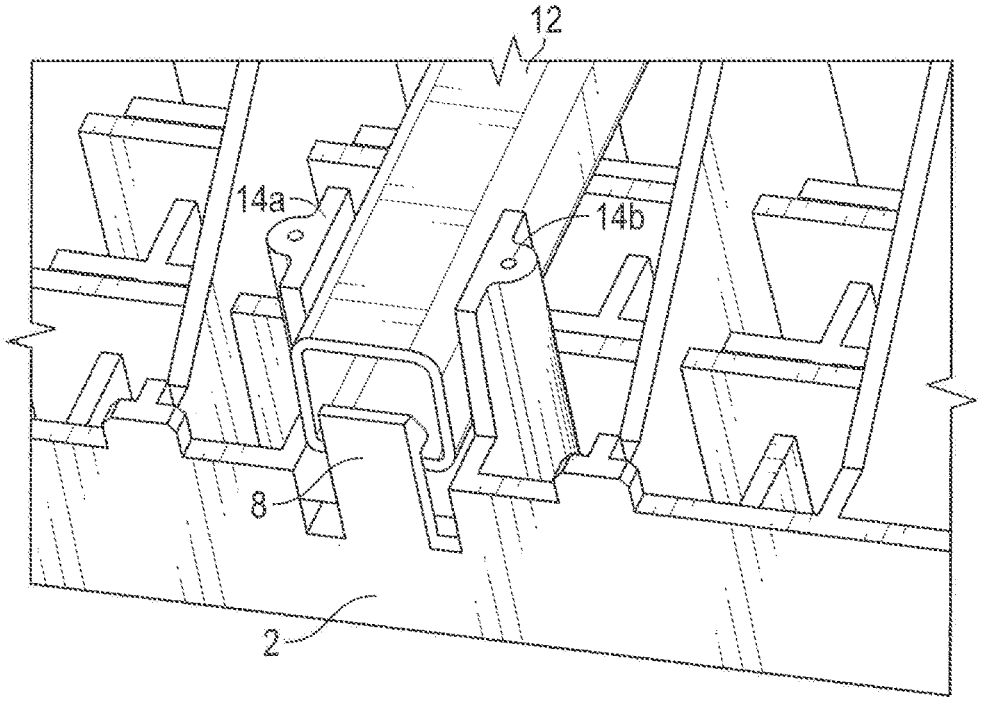
FIG. 2B is a detailed perspective view of an interconnection between a tab and one end of a brace in accordance with various embodiments of the invention.

FIG. 2B shows a detailed view of the interconnection between the end of the brace 12 and the tab 8 of the lid 2. The particular interconnection in this embodiment is a snap-fit joint where the tab 8 deflects away from the center of the lid 2 as the end of the brace 12 passes along the tab 8. Once the end of the brace 12 travels a sufficient distance, the tab 8 deflects inward and a hook on the end of the tab 8 is at least partially disposed within the receiving portion. An undercut on the tab 8 holds the brace 12 in place. While a snap-fit joint is described herein, it will be appreciated that other selective and permanent interconnections may be utilized in embodiments of the invention. For example, a two part adhesive may be used where one part of the adhesive is on the lid and the second part of the adhesive is on the brace. Once pressed together, the two-part adhesive binds the brace to the lid. In another embodiment, screws or bolts are used to selectively interconnect the brace to the lid.

Also shown in FIG. 2B are side tabs 14*a*, 14*b* positioned on either side of the first tab 8 to align and secure the brace 12. As the lid 2 moves into position on the brace 12, the side tabs 14*a*, 14*b* align the lid 2 in a lateral direction relative to the brace 12 to ensure a secure interconnection between the brace 12 and the lid 2. In addition, distal ends of the side tabs 14*a*, 14*b* may comprise recesses configured to receive bolts, screws, or other fasteners. A latch or member may be secured in place over the brace 12 once the brace is interconnected to the lid 2, further reinforcing the interconnection between the brace 12 and the lid 2.

Figure 3A:
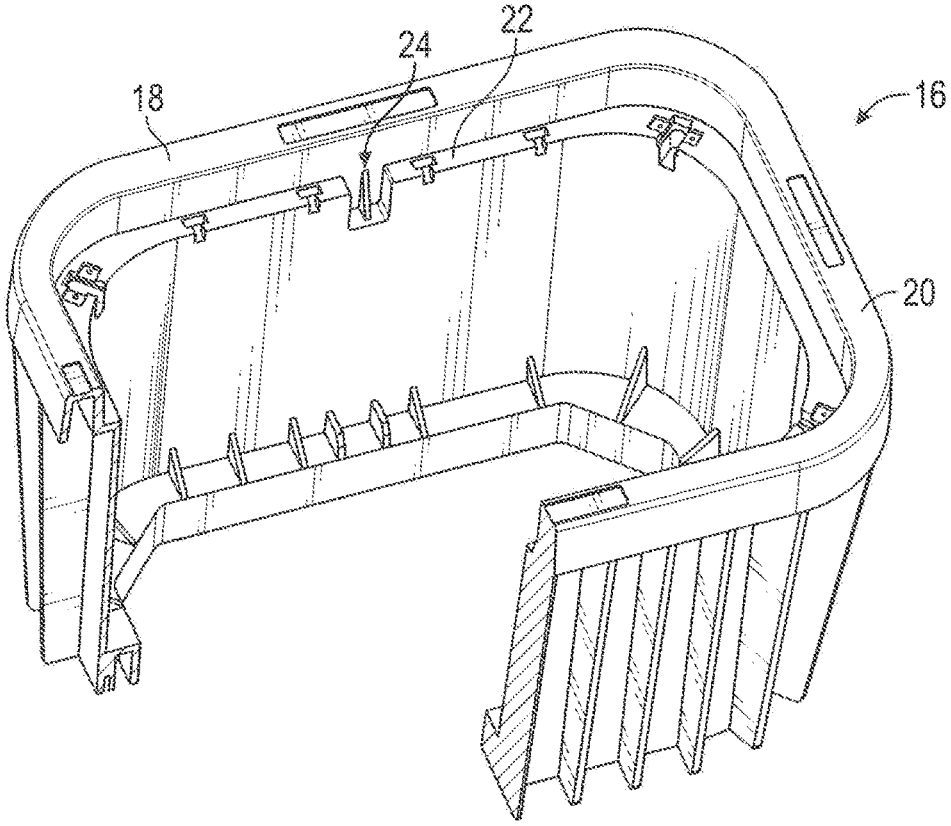
FIG. 3A is a perspective, cross-sectional view of a utility vault having a guide feature positioned on the sidewall in accordance with various embodiments of the invention.
Figure 3B:
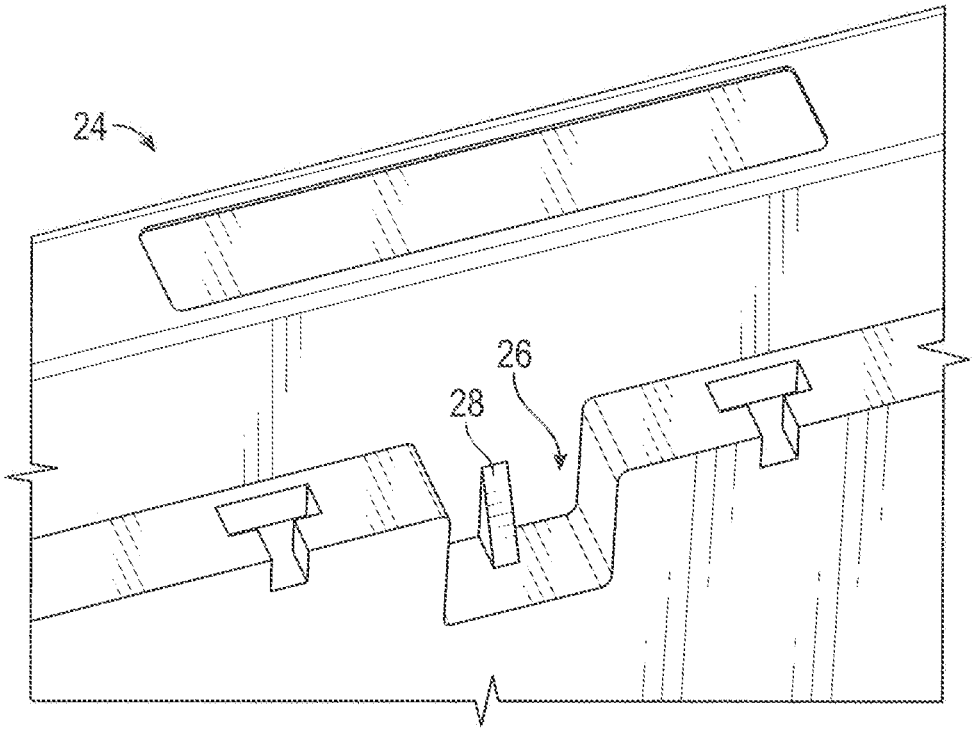
FIG. 3B is a detailed perspective view of a guide feature of a utility vault having a recess and a rib in accordance with various embodiments of the invention.
Figure 3C:
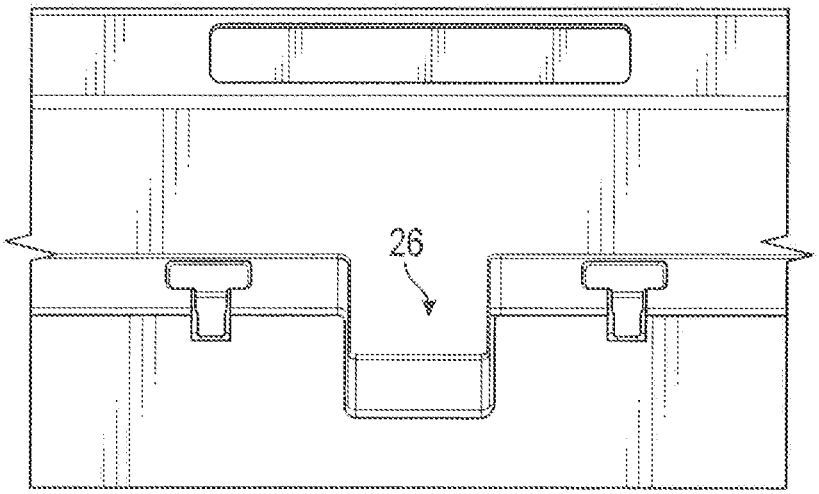
FIG. 3C is a detailed perspective view of a guide feature of a utility vault having a recess in accordance with various embodiments of the invention.

Now referring to FIGS. 3A-3C, perspective, cross-sectional views of a utility vault 16 are provided. The vault 16 in this embodiment has four sidewalls with a first wall 18 and a second wall 20 positioned opposite each other. It will be appreciated that embodiments of the vault 16 can have more or fewer walls, including at least one wall, which encompasses a cylindrical-walled vault 16. When a lid is placed on the vault, a lip of the lid contacts a top surface of the utility vault 16, and a distal end of the lattice structure on the lid contacts a shoulder 22 of the utility vault. This stepped contact between the lid and vault prevents lateral movement between the two components and allows only vertical movement between the lid and the vault.

A guide feature 24 is provided in the first wall 18 to properly align the brace before the lid is placed on the vault and the brace is interconnected to the lid. The guide feature 24 on the first wall 18 and a guide feature on the second wall 20 align the brace relative to the walls in longitudinal and lateral directions of the brace. The guide feature 24 generally comprises a recess 26 and a rib 28. The recess 26 substantially has the same dimensions as an outer surface of the brace. In other words, the outer dimension of the brace is within 5% of the dimension defined by the recess 26. Thus, when the brace is positioned in the two guide features, the brace is securely aligned in a lateral direction.

Next, the rib 28 of the guide feature 24 on the first wall and the rib of the guide feature on the second wall align the brace relative to the walls in a longitudinal direction. The rib 28 comprises a slope down toward the center of the vault. Similarly, the rib on the second wall also has a slope down toward the center of the vault. Therefore, if the brace is being lowered into the vault 16 and the brace is not longitudinally aligned, then the ribs 28 will channel the brace in the proper direction so that the brace rests in the vault in a predetermined location and orientation. It will be appreciated that embodiments of the present invention may not have a rib 28 with a slope, or even a rib 28 at all as shown in FIG. 3C. For example, in some embodiments, the rib 28 may be stepped where a lower step provides the longitudinal alignment function of the guide feature 24, and an upper, wider step provides a space or gap for a tab to deflect outward and around an edge of the brace. In a further example, the rib 28 has a concave or convex slope to longitudinally align the brace.

Figure 4:
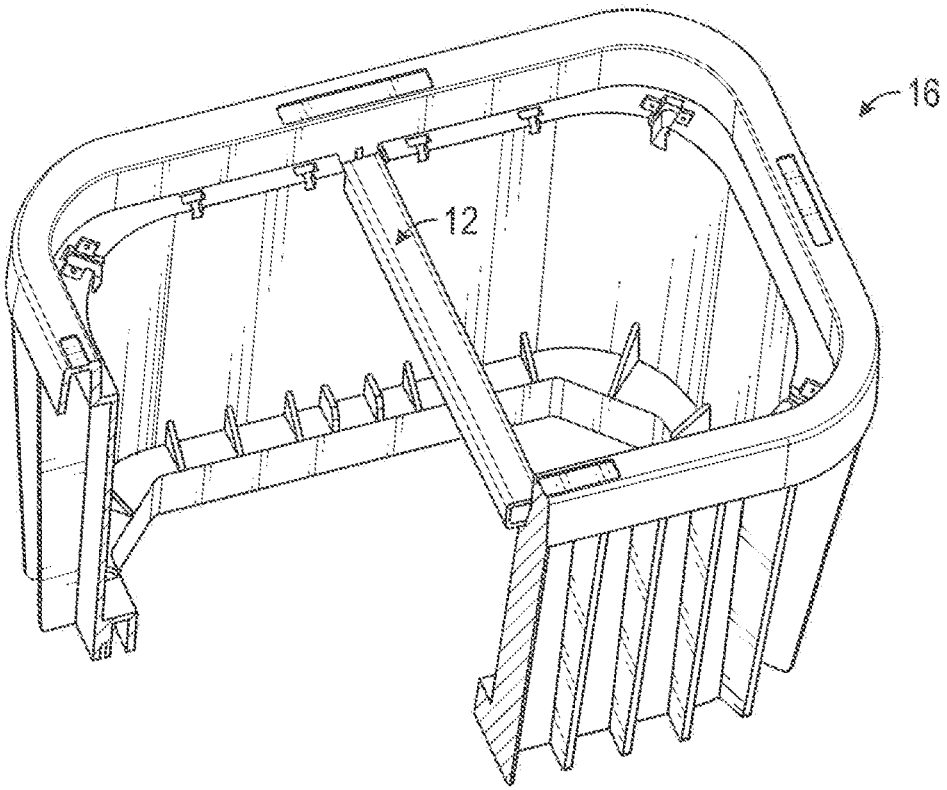
FIG. 4 is a perspective, cross-sectional view of a utility vault with a brace positioned on a guide feature in accordance with various embodiments of the invention.

Now referring to FIG. 4, a perspective, cross-sectional view of a utility vault 16 is provided where a brace 12 has been lowered into the vault 16. The recesses of the guide features align the brace 12 in a lateral direction, and the ribs of the guide features align the brace 12 in a longitudinal direction. The brace 12 rests in this predetermined position and orientation before a vault lid is lowered into place to selectively interconnect the brace 12 to the lid.

Figure 5:
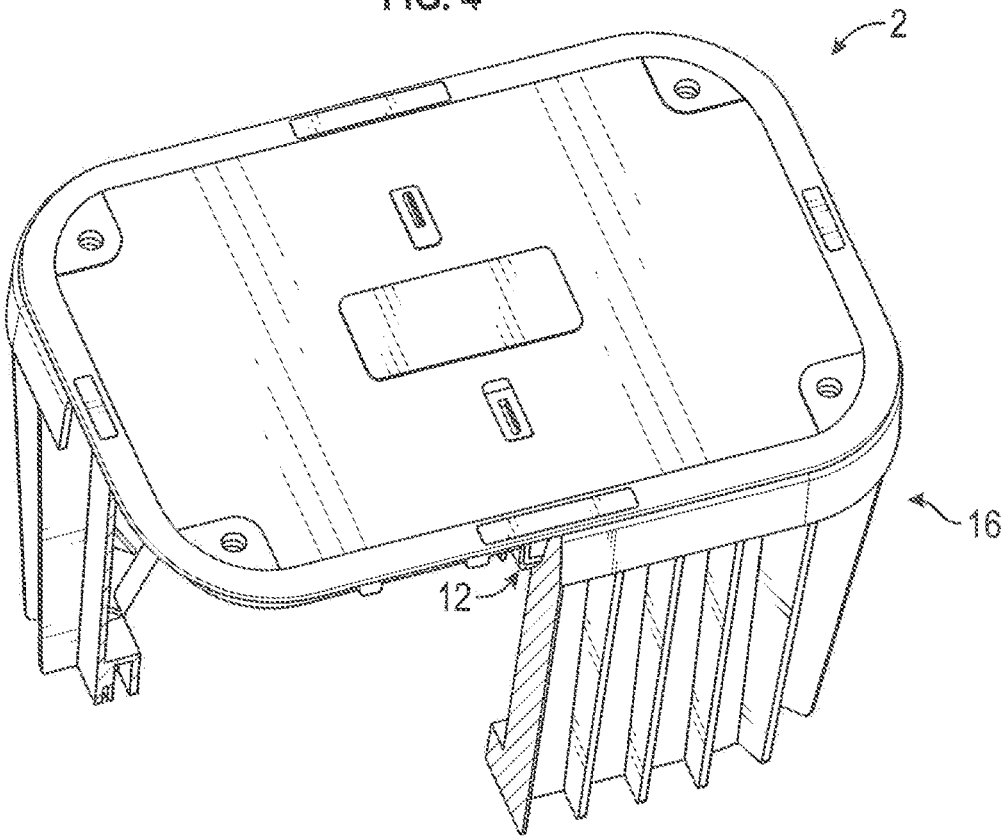
FIG. 5 is a perspective, cross-sectional view of a utility vault with a lid positioned on a top surface of the vault where a tab on the lid is interconnected to a brace in accordance with various embodiments of the invention.

Now referring to FIG. 5, a perspective, cross-sectional view of a utility vault 16 is provided where a lid 2 is lowered into place, causing the brace 12 to interconnect with the lid 2. The brace 12 in this embodiment runs between the two long sides of the lid 2 to reinforce the entire utility vault system. However, it will be appreciated that there may be other configurations of a brace 12 and lid 2 in various embodiments of the present invention. For instance, the brace 12 may be a cross shape with guide features 24 on each of the four walls. In another embodiment, the brace 12 is substantially ring shaped and arms extend from the ring to respective guide features.

Figure 6A:
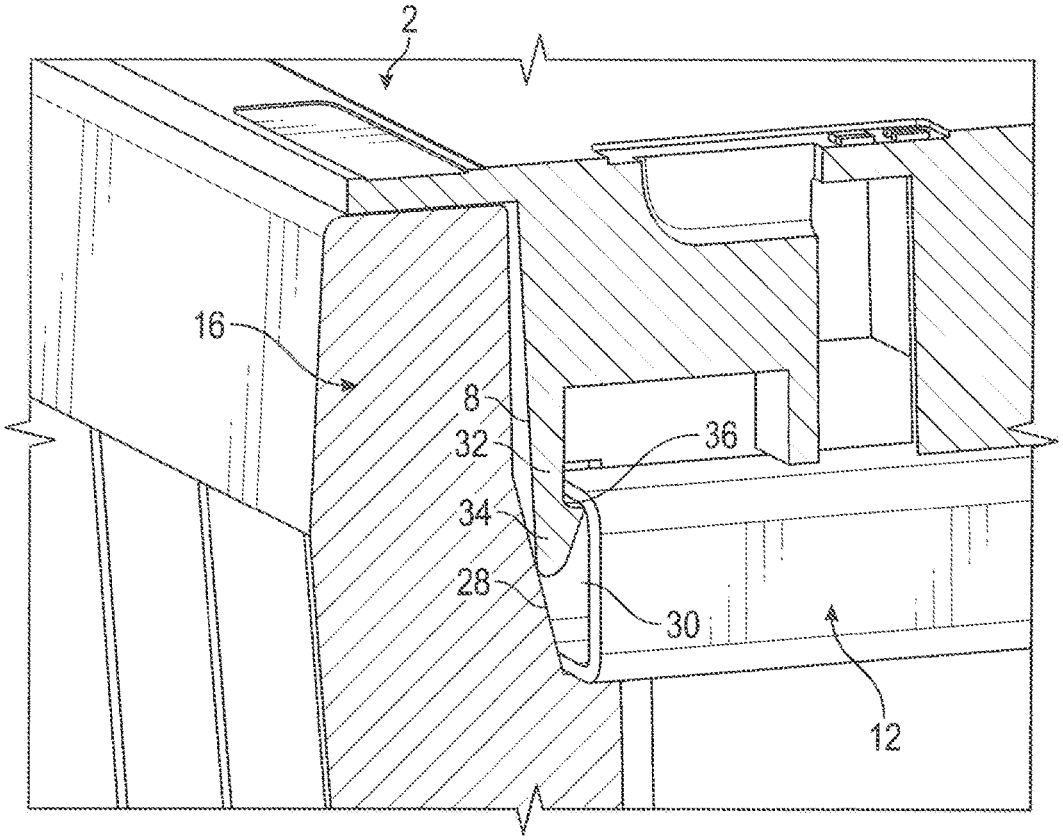
FIG. 6A is a perspective, cross-sectional view of a tab of a utility vault lid interconnected to an aperture in a brace in accordance with various embodiments of the invention.

Now referring to FIG. 6A, a perspective, cross-sectional view of the first tab 8 securing the brace 12 to the lid 2 is provided. A rib 28 with a slope is shown where the rib 28 has aligned the brace 12 in a longitudinal direction. The end of the brace 12 has a receiving portion 30, which in this embodiment is an aperture that extends through the entire longitudinal length of the brace 12. The tab 8 comprises an arm 32 with a hook 34 on a distal end of the arm 32. The arm 32 and hook 34 form an undercut 36. As the lid 2 is lowered into place, the hook 34 contacts the brace 12 and deflects the arm 32 of the tab 8 outward. Eventually, the hook 34 moves past an edge of the brace 12 and is positioned in the receiving portion 30 of the brace 12. This allows the arm 32 of the tab 8 to deflect inward, and the undercut 36 secures the tab 8 against the end of the brace 12.

Figure 6B:
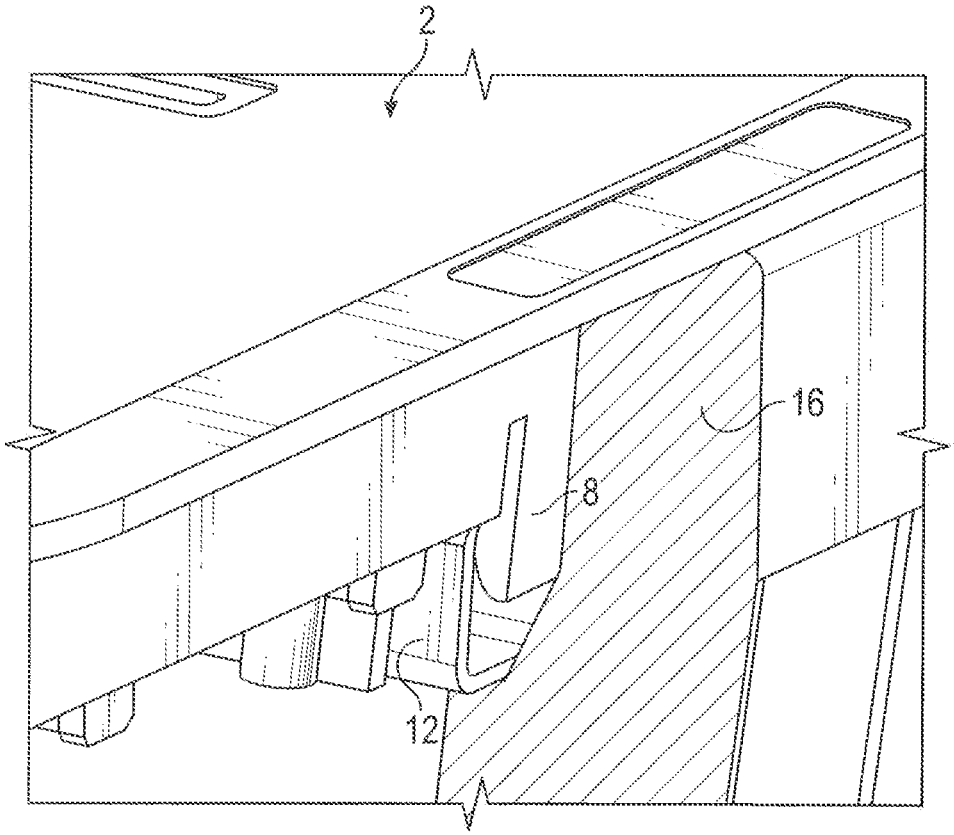
FIG. 6B is a perspective, cross-sectional view of a tab of a utility vault lid interconnected to an aperture in a brace in accordance with various embodiments of the invention.
Figure 6D:
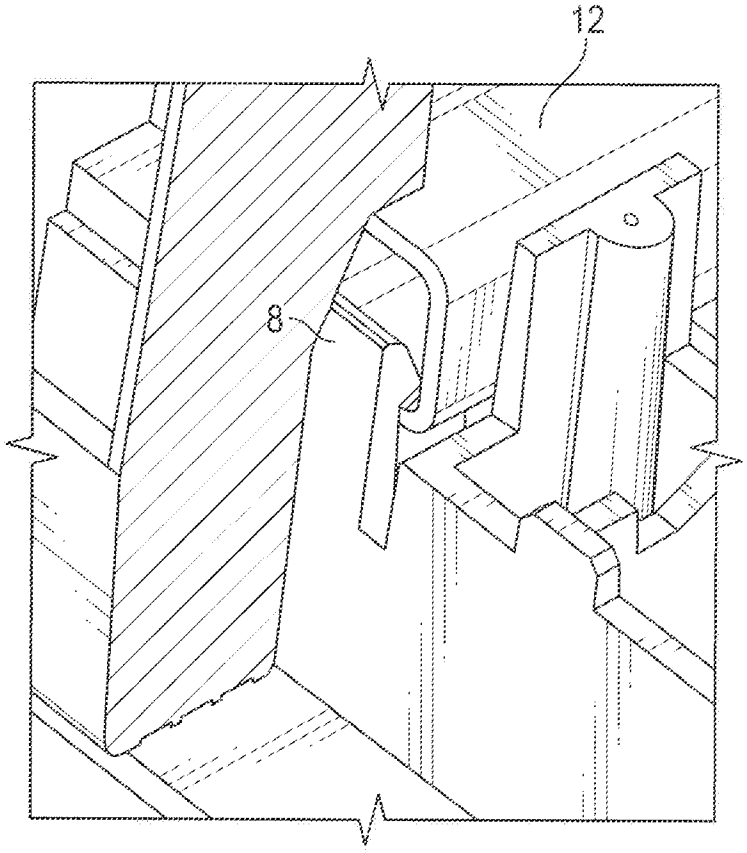
FIG. 6D is a perspective, cross-sectional view of a tab of a utility vault lid interconnected to an aperture in a brace in accordance with various embodiments of the invention.
Figure 6C:
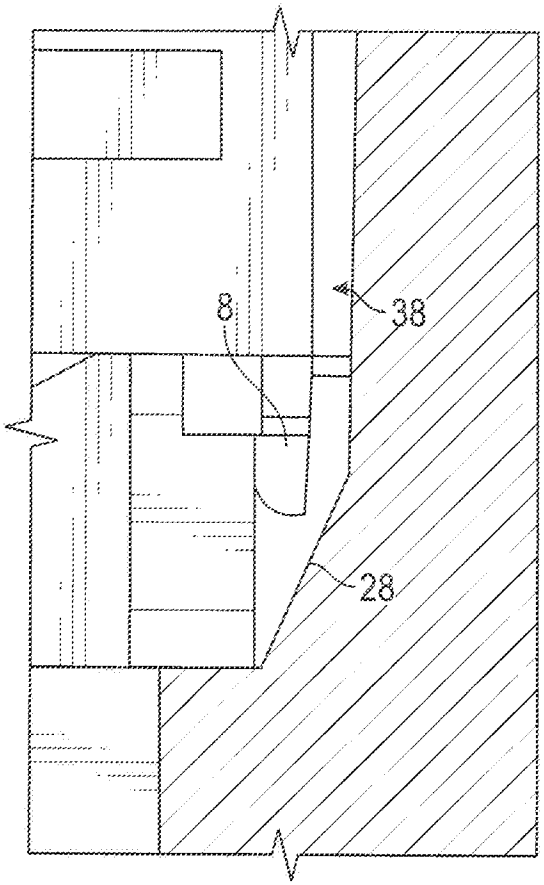
FIG. 6C is a cross-sectional view of a tab of a utility vault lid interconnected to an aperture in a brace in accordance with various embodiments of the invention.
Figure 7A:
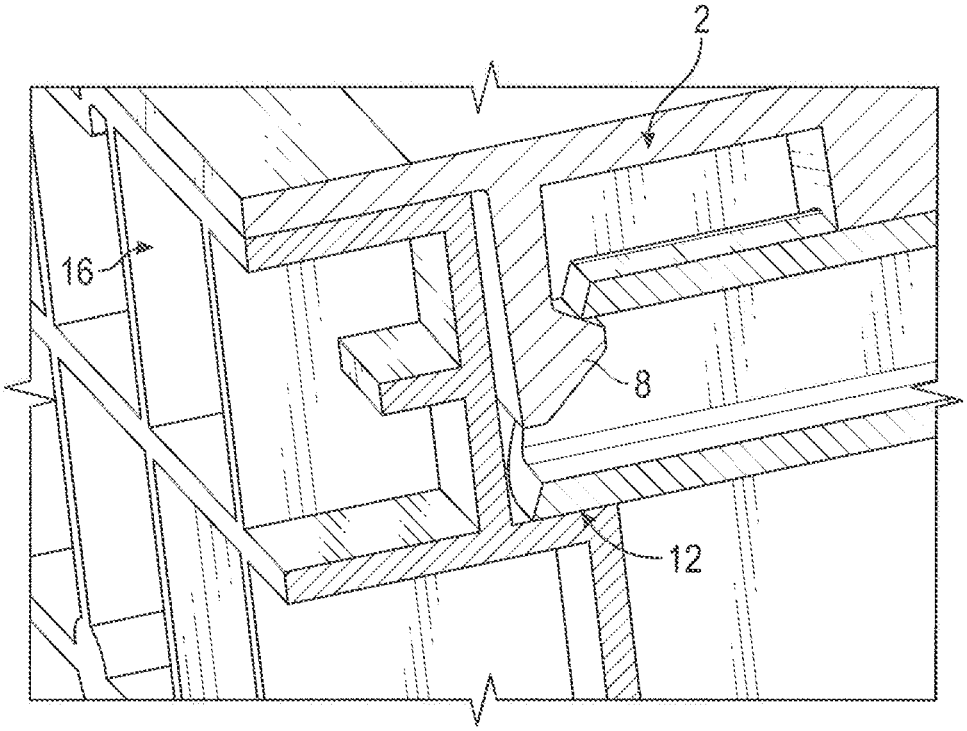
FIG. 7A is a perspective, cross-sectional view of a tab of a utility vault lid interconnected to an aperture in a mitered brace in accordance with various embodiments of the invention.
Figure 7B:
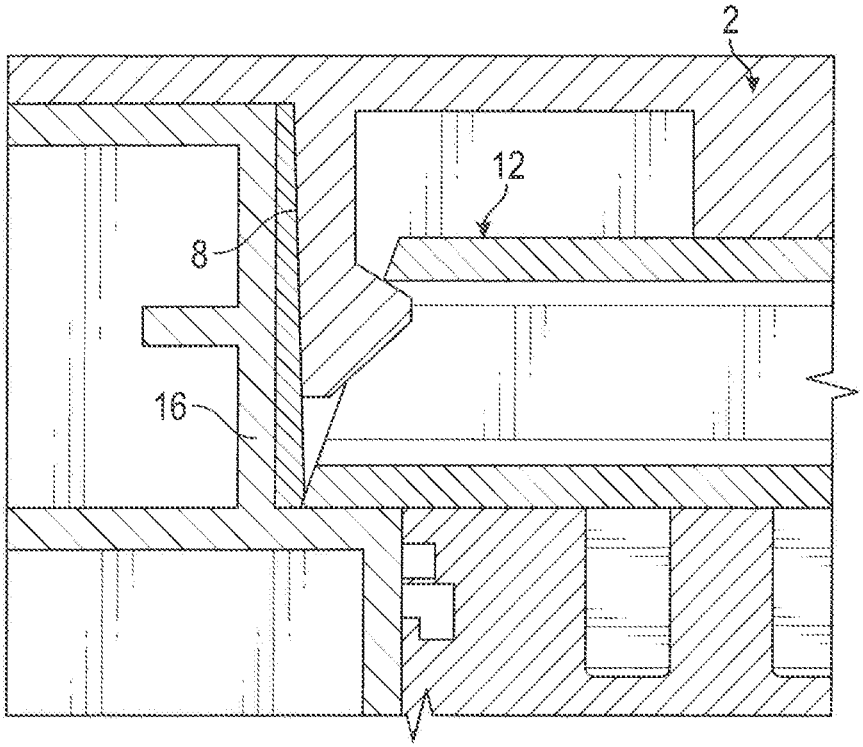
FIG. 7B is an elevation, cross-sectional view of a tab of a utility vault lid interconnected to an aperture in a mitered brace in accordance with various embodiments of the invention.
Figure 7C:
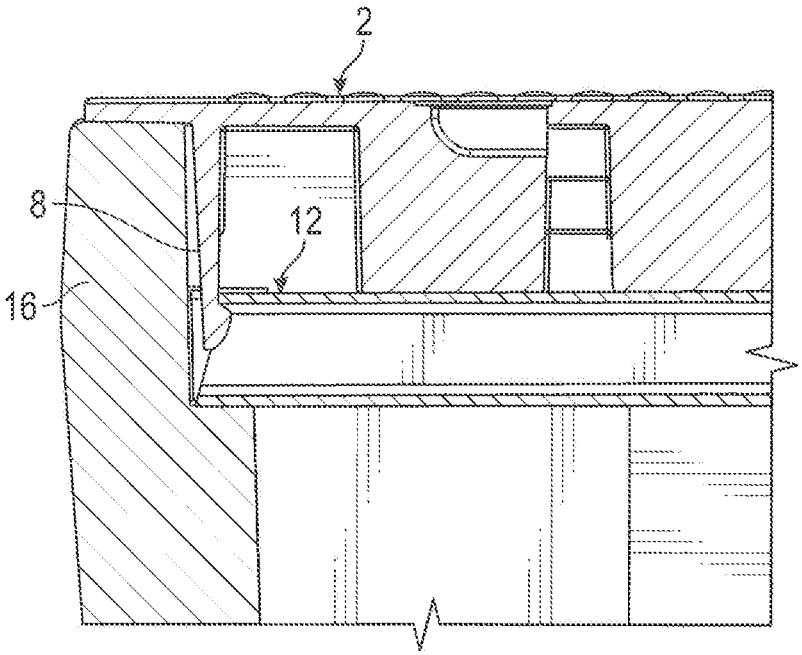
FIG. 7C is an elevation, cross-sectional view of a tab of a utility vault lid interconnected to an aperture in a mitered brace in accordance with various embodiments of the invention.
Figure 7D:
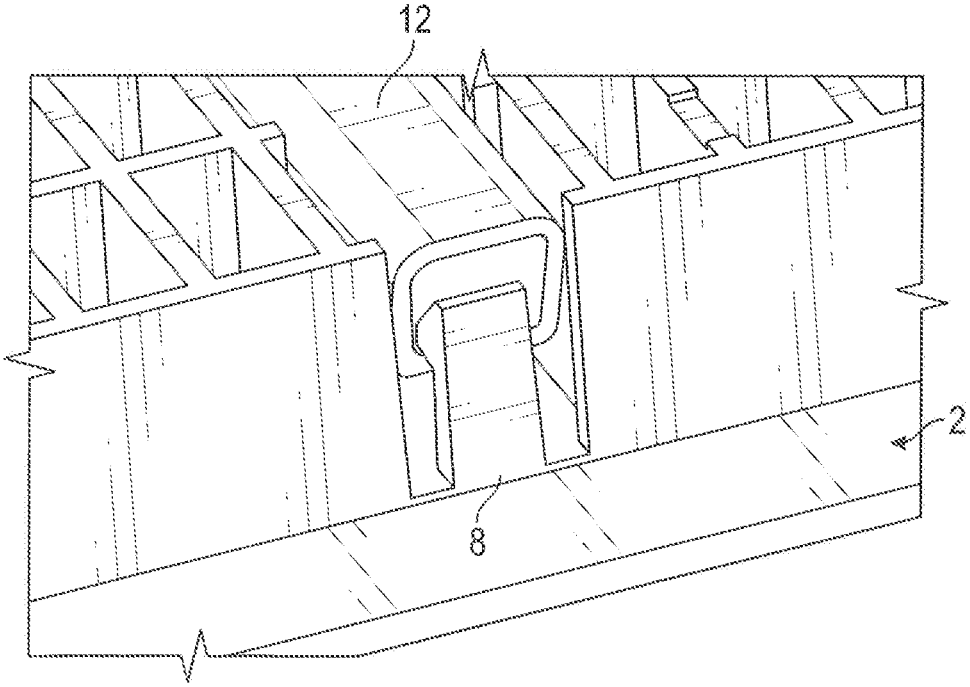
FIG. 7D is a perspective, cross-sectional view of a tab of a utility vault lid interconnected to an aperture in a mitered brace in accordance with various embodiments of the invention.

Now referring to FIGS. 6B-6D, various cross-sectional views of the brace 12 interconnected with the lid 2 are provided. Specifically referring to FIG. 6C, an elevation, cross-sectional view of the tab 8 is provided. Here, the tab 8 is interconnected to the brace 12, but a gap 38 is shown where the arm of the tab 8 may deflect outward to fit around an edge of the brace, then deflect back inward over a receiving portion or aperture in the brace 12.

Now referring to FIGS. 7A-7D, various cross-sectional views of a mitered brace 12 interconnected with the lid 2 are provided. The ends of the brace 12 may be mitered to provide a greater area of contact between the brace 12 and a recess of the utility vault. The greater area of contact reduces the stress and strain on the brace 12 when the utility vault is subjected to an external force or load.

The description of the present invention has been presented for purposes of illustration and description, but is not intended to be exhaustive or limiting of the invention to the form disclosed. Many modifications and variations will be apparent to those of ordinary skill in the art. The embodiments described and shown in the figures were chosen and described in order to best explain the principles of the invention, the practical application, and to enable those of ordinary skill in the art to understand the invention.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention, as set forth in the following claims.

What is claimed is:

1. A subgrade structure for providing an enclosure for storing utilities, comprising:

a vault having at least a first wall and an opposing second wall that at least partially define an enclosure;

a first guide feature positioned on said first wall, where said first guide feature comprises a first recess;

a second guide feature positioned on said second wall, wherein said second guide feature comprises a second recess;

a brace with a first end having a first receiving portion and a second end having a second receiving portion, wherein said first and second recesses of said first and second guide features are configured to receive said first and second ends of said brace, respectively; and a lid having a body oriented in a substantially horizontal plane, said lid having a first tab positioned along a first perimeter edge and a second tab positioned along a second perimeter edge, each of said first tab and said second tab extending from said body in a direction substantially perpendicular to said substantially horizontal plane, said first tab operable for interconnection to said first receiving portion of said brace, and said second tab operable for interconnection to said second receiving portion of said brace, wherein said lid is configured to cover an opening of said vault to form said enclosure.

2. The subgrade structure of claim 1, wherein said first tab of said lid comprises a hook disposed on a distal end of an arm.

3. The subgrade structure of claim 1, wherein an aperture extends from said first end to said second end of said brace to define said first receiving portion and said second receiving portion of said brace.

4. The subgrade structure of claim 1, wherein said first and second receiving portions are depressions in said brace.

5. The subgrade structure of claim 1, further comprising:

a first rib on said first guide feature; and a second rib on said second guide feature, wherein said first and second ribs are configured to align said brace relative to said first and second walls in a longitudinal direction of said brace.

6. The subgrade structure of claim 5, wherein said first rib has a downward slope toward a center of said vault, and said second rib has a downward slope toward said center of said vault.

7. The subgrade structure of claim 1, wherein said first recess is defined by two vertical walls and a lower wall configured to support said end of said brace, wherein said second recess is defined by vertical walls and a lower configured to support said second end of said brace, wherein said vertical walls defining said first and second recesses are configured to align said brace relative to said first and second walls of said vault in a lateral direction of said brace.

8. The subgrade structure of claim 1, further comprising:

a first side tab and a second side tab on said lid, wherein said first side tab and said second side tab are positioned on either side of said first tab, wherein said side tabs are configured to align said lid relative to said brace in a lateral direction of said brace.

9. The subgrade structure of claim 5, wherein said first rib and said second rib each have an upper surface configured to engage said brace, wherein said upper surfaces are substantially linear.

10. The subgrade structure of claim 1, further comprising:

a first space between a first end of said brace and said first wall, wherein said first tab deflects beyond said first end of said first brace by a predetermined distance, and said first space is larger than said predetermined distance.

11. A utility vault defining an enclosed volume, comprising:

at least one sidewall having a first guide feature and a second guide feature, wherein said guide features each comprise a recessed area;

a brace having a first end and a second end with an aperture extending through said brace between said first end and said second end, wherein said first and second guide features are configured to orient said brace into a predetermined position in a longitudinal direction of said brace such that there is a first space between said first end and said at least one sidewall and a second space between said second end and said at least one sidewall, and said recessed areas of said first and second guide features are configured to orient said brace into a predetermined position in a lateral direction of said brace, wherein said lateral direction is substantially perpendicular to said longitudinal direction; and a lid having a first tab and a second tab positioned on opposing peripheral walls, each tab having an arm and a hook, wherein said hook of said first tab is configured to deflect by a first predetermined distance and then deflect into said aperture of said brace, and said hook of said second tab is configured to deflect by a second predetermined distance and then deflect into said aperture of said brace to secure said brace to said lid, wherein said first predetermined distance is less than said first space, and said second predetermined distance is less than said second space.

12. The utility vault of claim 11, wherein said first and second ends of said brace are mitered at a non-perpendicular angle relative to said longitudinal direction of said brace.

* * * * *